US009713865B2

(12) United States Patent
Castillo et al.

(10) Patent No.: US 9,713,865 B2
(45) Date of Patent: Jul. 25, 2017

(54) ELECTROMECHANICAL SURFACE TEXTURING

(71) Applicant: Apple Inc., Cupertino, CA (US)

(72) Inventors: Alfredo Castillo, San Jose, CA (US); Adithya Raghavan, Los Altos, CA (US); Peter R. Muller, San Luis Obispo, CA (US)

(73) Assignee: Apple Inc., Cupertino, CA (US)

( * ) Notice: Subject to any disclaimer, the term of this patent is extended or adjusted under 35 U.S.C. 154(b) by 22 days.

(21) Appl. No.: 14/728,882

(22) Filed: Jun. 2, 2015

(65) Prior Publication Data

US 2016/0354890 A1 Dec. 8, 2016

Related U.S. Application Data

(63) Continuation of application No. PCT/US2015/033669, filed on Jun. 2, 2015.

(51) Int. Cl.
*B24B 1/00* (2006.01)
*B24B 31/10* (2006.01)
*B24B 31/00* (2006.01)

(52) U.S. Cl.
CPC ..... *B24B 1/005* (2013.01); *B24B 31/003* (2013.01); *B24B 31/102* (2013.01)

(58) Field of Classification Search
CPC ..... B24B 1/005; B24B 31/003; B24B 31/102
See application file for complete search history.

(56) References Cited

U.S. PATENT DOCUMENTS 2,735,231 A * 2/1956 Simjian ..... B24B 31/00 134/1
2,787,854 A * 4/1957 Simjian ..... B24B 31/102 451/113
2,880,554 A * 4/1959 Simjian ..... B24B 31/00 451/113
2,923,100 A * 2/1960 Simjian ..... B24B 31/102 451/113
3,533,928 A * 10/1970 Kiyoshi ..... B23H 9/02 204/155
3,848,363 A * 11/1974 Lovness ..... B24B 31/102 241/1
4,821,466 A * 4/1989 Kato ..... B24B 31/112 451/113
5,044,128 A * 9/1991 Nakano ..... B24B 31/108 451/104

(Continued)

OTHER PUBLICATIONS

PCT Application No. PCT/US2015033669—International Search Report and Written Opinion dated Feb. 16, 2016.

*Primary Examiner* — Timothy V Eley
(74) *Attorney, Agent, or Firm* — Downey Brand, LLP

(57) ABSTRACT

Magnetic apparatuses and systems for shaping parts are described. One or more magnets can be used to direct a magnetically responsive fluid having magnetically responsive particles around surfaces of a part. The magnetically responsive fluid can include abrasive particles that follow movement of the magnetically responsive fluid across surfaces of the part and remove material from the part until the part takes on a desired shape. The magnetic apparatuses can be configured to provide a rough cut, similar to machining process, and/or a fine cut, similar to polishing or buffing process, to the part.

20 Claims, 7 Drawing Sheets

(56) References Cited

U.S. PATENT DOCUMENTS

| | | | | |
|---|---|---|---|---|
| 5,419,735 | A * | 5/1995 | Imahashi | B24B 1/005 451/104 |
| 5,662,516 | A * | 9/1997 | You | B24B 31/102 451/104 |
| 5,957,753 | A | 9/1999 | Komanduri et al. | |
| 6,146,243 | A * | 11/2000 | Imahashi | B24B 1/005 451/104 |
| 6,227,942 | B1 | 5/2001 | Hoffman | |
| 6,231,426 | B1 * | 5/2001 | Liao | B24B 31/102 451/32 |
| 6,270,398 | B1 * | 8/2001 | Liao | B24B 31/102 451/326 |
| 6,413,441 | B1 | 7/2002 | Levin | |
| 8,568,200 | B2 * | 10/2013 | Liao | B24B 31/112 451/104 |
| 8,915,769 | B2 * | 12/2014 | Kamikihara | B24B 1/005 451/29 |
| 2003/0040259 | A1 * | 2/2003 | Umehara | B24B 1/002 451/8 |
| 2003/0216109 | A1 | 11/2003 | Riviere et al. | |
| 2005/0094906 | A1 * | 5/2005 | Satoh | B23H 9/00 384/107 |
| 2015/0093970 | A1 | 4/2015 | Greenslet | |
| 2015/0375359 | A1 * | 12/2015 | Cui | B24B 1/005 451/59 |

* cited by examiner

ELECTROMECHANICAL SURFACE TEXTURING

CROSS-REFERENCE TO RELATED APPLICATION

This is a continuation of International Application PCT/US15/33669, with an international filing date of Jun. 2, 2015, entitled "ELECTROMECHANICAL SURFACE TEXTURING", which is incorporated herein by reference in its entirety.

FIELD

The described embodiments relate generally to methods of shaping a workpiece using a magnetically responsive fluid, such as a ferrofluid, that includes abrasive particles. Magnets can be positioned with respect to a surface of the workpiece in a way that directs the magnetically responsive fluid with abrasive particles in a path across the surface, creating a cutting action that shapes the workpiece.

BACKGROUND

Many consumer electronic devices have outer enclosures and coverings that give the enclosures and coverings an aesthetically pleasing look and feel. Some enclosures and coverings have curved surfaces that add to the aesthetic appeal of the device. Often, the enclosures and coverings undergo finishing operations in order to impart distinctive characteristics to the enclosures and coverings. For example, surfaces can be texturized to give the enclosures and coverings a matte look and feel. Other times, the surfaces are polished to a mirror shine. The finishing process can also remove surface defects that would otherwise be visible and detract from the aesthetic appeal of the enclosure or covering.

One challenge associated with finishing curved surfaces is that it can be difficult to follow a contour of a curved surface using conventional finishing techniques. For example, it can be difficult to control fine movement of a flat sanding belt or round abrasive wheel over curved edges and corners of a part. The resultant part can have an uneven finish at the curved edges and corners. It can be especially difficult to control the finishing process if the curved surface has a complex three-dimensional shape, such as a spline shape.

SUMMARY

This paper describes various embodiments that relate to shaping parts using electromechanical techniques. In particular embodiments, the parts are shaped using magnets to move a magnetically responsive fluid having abrasive particles over surfaces of the parts.

According to some embodiments, a method of shaping a workpiece is descried. The method includes moving a magnetically responsive fluid in a path across a surface of the workpiece. The magnetically responsive fluid has magnetically attractable particles and abrasive particles suspended in a carrier fluid. The path is defined by one or more magnets positioned with respect to the surface of the workpiece such that movement of the magnetically responsive fluid provides a cutting action sufficient to remove material from the workpiece resulting in the workpiece taking on a predefined shape.

According to another embodiment, a magnetic shaping apparatus is described. The magnetic shaping system includes a container configured to hold a magnetically responsive fluid and a workpiece immersed in the magnetically responsive fluid. The magnetically responsive fluid has magnetically attractable particles and abrasive particles suspended in a carrier fluid. The magnetic shaping system also includes a magnet arranged with respect to the workpiece such that the magnet directs movement of the magnetically responsive fluid in a path across a surface of the workpiece. Movement of the magnetically responsive fluid provides a cutting action sufficient for the abrasive particles to remove material from the workpiece resulting in the workpiece taking on a predefined shape.

According to a further embodiment, a magnetic shaping apparatus is described. The magnetic shaping system includes a container configured to hold a magnetically responsive fluid and a workpiece immersed in the ferrofluid, the ferrofluid having abrasive particles. The magnetic shaping system also includes an electromagnet arranged with respect to the workpiece such that a magnetic field of the electromagnet directs movement of the ferrofluid in a path across a surface of the workpiece. Movement of the ferrofluid provides a cutting action sufficient for the abrasive particles to remove material from the workpiece. The magnetic shaping apparatus further includes a power supply configured to supply varying amounts of electric current to the electromagnet. An amount of electric current supplied to the electromagnet is associated with a strength of the magnetic field.

These and other embodiments will be described in detail below.

BRIEF DESCRIPTION OF THE DRAWINGS

The disclosure will be readily understood by the following detailed description in conjunction with the accompanying drawings, wherein like reference numerals designate like structural elements.

DETAILED DESCRIPTION

Figure 1:
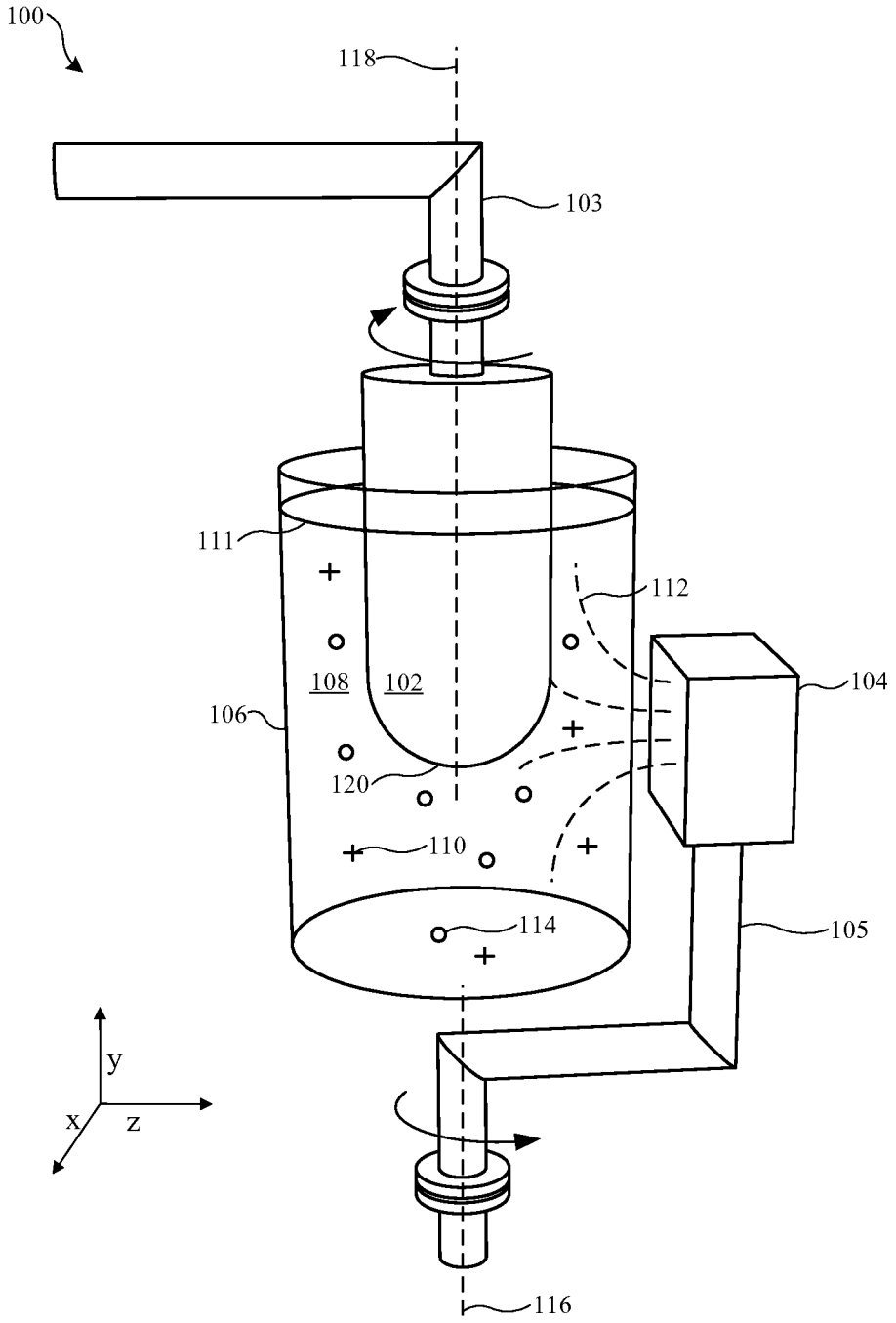
FIG. 1 shows a magnetic shaping apparatus used to shape a surface of a workpiece, in accordance with some embodiments.

Reference will now be made in detail to representative embodiments illustrated in the accompanying drawings. It should be understood that the following descriptions are not intended to limit the embodiments to one preferred embodiment. To the contrary, it is intended to cover alternatives, modifications, and equivalents as can be included within the spirit and scope of the described embodiments as defined by the appended claims.

The following disclosure relates to use of magnetic systems to mechanically shape and/or finish a surface of a workpiece. In some embodiments, the magnetic systems include electromagnets, and therefore can be referred to as electromechanical systems. In particular embodiments, the shaping and/or surface finishing methods include the use of magnetically responsive fluids, such as ferrofluids. Magnets can be used to guide the magnetically responsive fluids in paths across surfaces of the workpiece. The magnetically responsive fluids can include abrasive particles that abrade or otherwise cut into surfaces of the workpiece such that some material is removed from the workpiece, resulting in the workpiece taking on a final desired shape.

The magnetically responsive fluid can have magnetically responsive particles that respond to a magnetic field produced by a nearby magnet or system of magnets. The magnet(s) can be arranged to define a path in which the magnetically responsive fluid moves with respect to the workpiece. In some cases, the magnetically responsive particles are harder than the workpiece. Thus, the relative movement of the magnetically responsive particles can abrade the surface of the workpiece. In some cases, separate abrasive particles are added to the magnetically responsive fluid to provide the abrasive action. The methods can be used to provide precise removal of material in predefined areas of the workpiece and achieve a final workpiece shape that can be difficult to achieve using conventional machining, abrading, polishing and buffing techniques.

The systems and methods described herein can be use to form complex geometries, such as spline-shaped surfaces, within a workpiece that are difficult to achieve using traditional machining and polishing techniques. This is, in part, because the magnetically responsive fluid can move in a fluid and well-controlled manner over surfaces of the workpiece. In addition, it can be possible to finish hard to reach places of the workpiece, such as small grooves or undercut areas of the workpiece.

The methods and systems can be used to shape a workpiece on a macro-scale, similar to conventional machining processes, and/or on a micro-scale, similar to conventional polishing and buffing processes. These can be referred to as rough cutting and fine cutting techniques, respectively. In some embodiments, the same system can be used to perform rough cutting and fine cutting of the workpiece. For example, a first magnetically responsive fluid having aggressively abrasive particles can be used to perform the rough cutting. Then, the system can be replaced with a second magnetically responsive fluid having less abrasive particles to perform the fine cutting. In some embodiments, chamfers are formed and polished within a workpiece using the methods described herein.

Since the magnetically responsive fluid is in liquid form instead of powder form, the methods described herein can be safer that traditional polishing and abrasive texturing techniques that use dry powdered abrasive materials. In particular, use of dry powdered materials can be an explosive hazard, especially when heat from friction is generated. In contrast, the magnetically responsive fluid can remain in liquid form through the shaping process, reducing the risk of explosion related to powdered materials.

In some embodiments, the magnetic shaping methods are combined with other types of shaping processes. For example, the methods can be combined with a forging process, whereby the workpiece is intentionally heated to a predetermined temperature sufficient to place the workpiece in a more malleable and forgeable state. The magnetically induced shaping process can then exert a force on the workpiece that forges the workpiece in addition to finishing the workpiece surface.

In some embodiments, the workpiece is mapped in three-dimensions such that the shaping process can be adjusted in real time. One advantage of using the magnetic-based shaping methods compared to conventional shaping techniques such as machining and traditional polishing operations is that it may be possible to accomplish a pre-determined final shape of the workpiece without the use of traditional computerized numerical code (CNC). For example, it may be possible to create the final shape based on a three-dimensional representation, such as a computer-aided design (CAD) drawing.

Methods described herein are well suited for providing cosmetically appealing and/or functional parts of consumer products. For example, the methods described herein can be used to form enclosures or portions of enclosures for electronic devices, such as computers, portable electronic devices, wearable electronic devices and electronic device accessories, such as those manufactured by Apple Inc., based in Cupertino, Calif.

These and other embodiments are discussed below with reference to FIGS. 1-7. However, those skilled in the art will readily appreciate that the detailed description given herein with respect to these Figures is for explanatory purposes only and should not be construed as limiting.

FIG. 1 shows magnetic shaping apparatus 100 used to shape a surface of workpiece 102 in accordance with some embodiments. Apparatus 100 includes container 106 that is configured to contain magnetically responsive fluid 108 and magnet 104. It should be noted that although FIG. 1 shows magnet 104 outside of container and magnetically responsive fluid 108, in other embodiments magnet 104 is positioned within of magnetically responsive fluid 108 and container 106. Workpiece 102 can be supported by first fixture 103 and magnet 104 can be supported by second fixture 105.

Magnetically responsive fluid 108 can be any suitable fluid that responds to the presence of a magnetic field. Magnetically responsive fluid 108 can be in colloidal form with magnetically responsive particles 110 suspended within the carrier fluid 111, or a non-colloidal form, such as when magnetically responsive particles 110 are very small and/or soluble within carrier fluid 111. In some embodiments, magnetically responsive fluid 108 is a ferrofluid that becomes magnetized in the presence of a magnetic field. In general, a ferrofluid is a colloidal liquid that includes magnetically responsive particles 110, which are ferromagnetic in nature, suspended within carrier fluid 111. Magnetically responsive particles 110 are made of a material that responds to the presence of a magnetic field, such as one or more of iron, nickel, cobalt, rare earth metals (e.g., neodymium) and certain minerals. In some embodiments, magnetically responsive particles 110 are magnetized such that they are permanent magnets. In other embodiments, magnetically responsive particles 110 are not permanent magnets but are responsive to magnets. Container 106 can be made of any material suitable for containing magnetically responsive fluid 108. In some embodiments, container 106 is made of plastic, glass, ceramic, or metal that does not substantially magnetically interact with magnet 104 and/or magnetically responsive fluid 108.

Workpiece 102 can be made of any suitable metal material and or non-metal material, such as plastic, glass and/or ceramic. In some embodiments, workpiece 102 is made of a combination of metal and non-metal materials. In one embodiment, workpiece 102 is made of aluminum or aluminum alloy. In another embodiment, workpiece 102 is made of a molded plastic material. Magnetically responsive fluid 108 can include abrasive particles 114, which are made of one or more materials that are abrasive in nature such that abrasive particles 114 can abrade and remove some material from workpiece 102. Thus, the material of abrasive particles 114 can depend, in part, on the hardness of the material of workpiece 102. In some embodiments, abrasive particles 114 are made of one or more non-metallic materials, such as zirconia, alumina, titania, and/or iron oxide, or one or more metallic materials. In some embodiments, abrasive particles 114 include one or more non-metallic materials and one or more metallic materials.

Magnet 104 is situated with respect to workpiece 102 such that magnetic fields 112 of magnet 104 influence magnetically responsive fluid 108 near surfaces of workpiece 102. Apparatus 100 is arranged to provide relative motion between workpiece 102 and magnetically responsive fluid 108. For example, workpiece 102 can be rotated about first axis 118 using first fixture 103. Alternatively, magnet 104 can be rotated about second axis 116 using second fixture 105. This can be accomplished by arranging first fixture 103 and/or second fixture 105 to respective motors (not shown). In some embodiments, both workpiece 102 and magnet 104 are rotated.

The relative movement of workpiece 102 with respect to magnetically responsive fluid 108 can cause abrasive particles 114 within magnetically responsive fluid 108 to provide a cutting action on surfaces of workpiece 102, such as at curved surface 120 of workpiece 102. That is, the relative motion between workpiece 102 and magnetically responsive fluid 108 changes the magnetic field 112 at curved surface 120, which causes movement of magnetically responsive particles 110 near curved surface 120. Abrasive particles 114 become entrained with the movement of magnetically responsive particles 110, which cases abrasive particles 114 to contact and rub up against curved surface 120. In this way, abrasive particles 114 can remove material form workpiece 102 at surface 120 and shape curved surface 120. In some embodiments where the cutting action is strong enough, abrasive particles 114 can remove larger portions of material from workpiece 102 similar to a cutting or machining operation. These types of shaping operations can be referred to as rough cutting. In other embodiments, the cutting action is lessened so as to provide a polishing effect to curved surface 120. These types of shaping operations can be referred to as fine cutting.

In some embodiments, magnetically responsive particles 110 are also made of an abrasive material that can also abrade and remove material from workpiece 102. In some embodiments where magnetically responsive particles 110 are made of sufficiently abrasive material for shaping and/or finishing workpiece, separate abrasive particles 114 are not used. Note that if workpiece 102 includes an electrically conductive metal, it may be necessary to ground workpiece 102 so as to prevent interaction of workpiece 102 with electric currents (if any) generated by relative movement of magnetically responsive fluid 108 with respect to workpiece 102.

The size and shape of abrasive particles 114 can vary depending on design requirements and desired outcome. For example, abrasive particles 114 can be sized and shaped to provide relatively fast cutting of workpiece 102. In these cases, abrasive particles 114 can have sharp edges. In addition, abrasive particles 114 can have a relatively large average size, such as having average diameters in hundreds of nanometers or even in millimeters, which can provide relatively aggressive cutting action. In other embodiments, abrasive particles 114 have relatively smooth and rounded (e.g., spherical) shapes that provide more gentle abrasive action for finer polishing action. It may be desirable for abrasive particles 114 to be relatively small, such as having an average diameter in the scale of nanometers, to provide a relatively gentle cutting action. Any suitable combination of shape (spherical and/or sharp edged) and average size (nanometer and/or millimeter scale diameters) can be used depending on desired outcome.

The constitution of carrier fluid 111 can vary depending on the type of magnetically responsive particles 110 and/or abrasive particles 114, as well as desired properties magnetically responsive fluid 108. For example, the material of carrier fluid can be chosen based on its lubrication, cooling, viscosity and solvation properties. In some cases, carrier fluid 111 dissipates heat from friction generated by movement of magnetically responsive particles 110 with respect to workpiece 102. Carrier fluid 111 can also act as a lubricant that reduces friction between magnetically responsive particles 110 and/or abrasive particles 114 against workpiece 102. In some embodiments, carrier fluid 111 includes an aqueous solution. In other embodiments, carrier fluid 111 includes an organic solvent. In some embodiments, carrier fluid 111 includes a combination of aqueous and organic solutions. In some embodiments, carrier fluid 111 has one or more surfactants that can inhibit clumping of magnetically responsive particles 110 and/or abrasive particles 114.

One important factor to consider in choosing process parameters of a shaping operation can be the viscosity of magnetically responsive fluid 108. The viscosity of magnetically responsive fluid 108 is related to the ease of movement of magnetically responsive fluid 108. That is, the higher the viscosity of magnetically responsive fluid 108, the more force required to move magnetically responsive fluid 108 around workpiece 102. The viscosity of magnetically responsive fluid 108 can depend on the viscosity of carrier fluid 111, as well as the density of magnetically responsive particles 110 and abrasive particles 114 within carrier fluid 111. In addition, the temperature of magnetically responsive fluid 108 can affect the viscosity of magnetically responsive fluid. For example, magnetically responsive fluid 108 at higher temperatures can make it less viscous. Therefore, it may be desirable to heat magnetically responsive fluid 108 using an external heat source, such as a hot plate or heat lamp (not shown). In addition, friction of magnetically responsive fluid 108 against workpiece 102 can also generate heat, which can also affect the viscosity of magnetically responsive fluid 108. In some cases, magnetically responsive fluid 108 is maintained at a predetermined viscosity to reduce the occurrence of agglomeration of magnetically responsive particles 110 and/or abrasive particles 114. This can be important if such agglomeration can lead to pitting or denting of workpiece 102 during the shaping operation. However, it may be also important to assure that workpiece 102 does not reach a high enough temperature to cause deformation of workpiece 102.

Magnet 104 should be strong enough such that magnetic field 112 can control movement of magnetically responsive fluid 108 with respect to curved surface 120 of workpiece 102 of keep magnetically responsive fluid 108 stable with respect to curved surface 120 if workpiece 102 is moved (e.g., rotated). The strength of the magnetic field 112 can depend on the type of magnet 104. In some embodiments, magnet 104 includes a permanent magnetic material, such as magnetized iron, nickel, cobalt and/or rare earth magnetic material. In some embodiments, magnet 104 is an electromagnet, which is magnetized by an electric current provided by one or more power supplies (not shown). For example, a power supply can be electrically coupled to magnet 104 via second fixture 105. In some embodiments, magnet 104 is a superconducting magnet. In some embodiments, magnet 104 includes a combination of permanent magnet(s), electromagnet(s) and superconducting magnet(s).

One advantage of using an electromagnet is that the amount of current supplied to magnet 104 can be controlled, thereby controlling the strength of magnetic field 112. In some embodiments, magnetic field 112 is changed over time, such as by increasing and decreasing an amount of electric current to magnet 104. This can create a pulsing action where magnetically responsive particles 110 are pull toward and away from magnet 104. For example, a current can be applied to magnet 104 for a first period of time, and then the current can be removed (turned off) for a second period of time. This can be repeated such that a pulsing action is created across magnetically responsive fluid 108 that pulls and pushes abrasive particles 114 across surface 120 of workpiece 102. In some embodiments, the amount of current is gradually changed such that movement of magnetically responsive fluid 108 is correspondingly smooth. In other embodiments, the amount of current is abruptly changed such that the movement of magnetically responsive fluid 108 is correspondingly abrupt.

In some embodiments, the polarity of magnet 104 is switched during the shaping operation. For example, a first electric current can be applied to magnet 104 that makes magnet 104 have a positive polarity for a first period of time. Then a second electric current can be applied to magnet 104 that makes magnet 104 have a negative polarity for a second period of time. This polarity switching can be repeated creating another type of pulsing effect, which can be similar to or different than the pulsing effect caused by increasing and decreasing the strength of magnetic field 112. In some embodiments, a combination of increasing/decreasing the electric current and switching the polarity of magnet 104 is used to create particular movements of magnetically responsive fluid 108 around workpiece 102.

In some embodiments, apparatus 100 is configured to interact with a computerized mapping system. The computerized mapping system can determine the three-dimensional position of workpiece 102 within apparatus 100 and/or the shape of workpiece 102. For example, an imaging system, such as those including sensors and/or a charge-coupled device (CCD), can collect image data of workpiece 102. The image data can be then be entered into a computer that calculates the position and/or shape of workpiece 102 in three-dimensional space (x, y, z). This three-dimensional position data can then be used to make decisions as to changing magnetic field 112 in real time during the shaping operation. Features of a suitable electronic system for accomplishing computerized mapping are described below with respect to FIG. 7.

In particular embodiments, a replica fixture (not shown) is used to mimic hand motions of an operator such that precise control over the shaping of workpiece 102 can be achieved. The replica fixture can be computationally mapped similar to apparatus 100 in order to collect and store another set of positional data in three-dimensional space ($x_1$, $y_1$, $z_1$) related to the replica fixture in the computer. The replica fixture can have a corresponding sensors and/or CCD imaging system that is configured to detect in real time the location in three-dimensional space of an object, such as a operator's hand, that is within the replica fixture. The computer can then be used to adjust magnetic field 112 and direct magnetically responsive fluid 108 in apparatus 100 in accordance with movement of the operator's hand within the replica fixture during a shaping operation. In this way, the shaping operation can be performed in a manner precisely in accordance with a user's directive. This application can be useful for artistic purposes since a user can observe the shaping of workpiece 102 during the shaping operation and adjust further shaping based on how workpiece 102 appears to change.

In some embodiments, apparatus 100 can be used to rework workpiece 102. For example, prior to the shaping operation is performed, an operator can identify areas of workpiece 102 that need rework. The operator can then apply a substance, such as adhesive having some abrasive particles 114 therein, on these rework areas. When workpiece 102 undergoes the shaping process, the rework areas of workpiece 102 having the substance with some abrasive particles 114 adhered thereon can become abraded faster than areas of workpiece 102 without abrasive particles 114 adhered thereon. In this way, localized machining at identified rework regions can be preferentially abraded.

Figure 2:
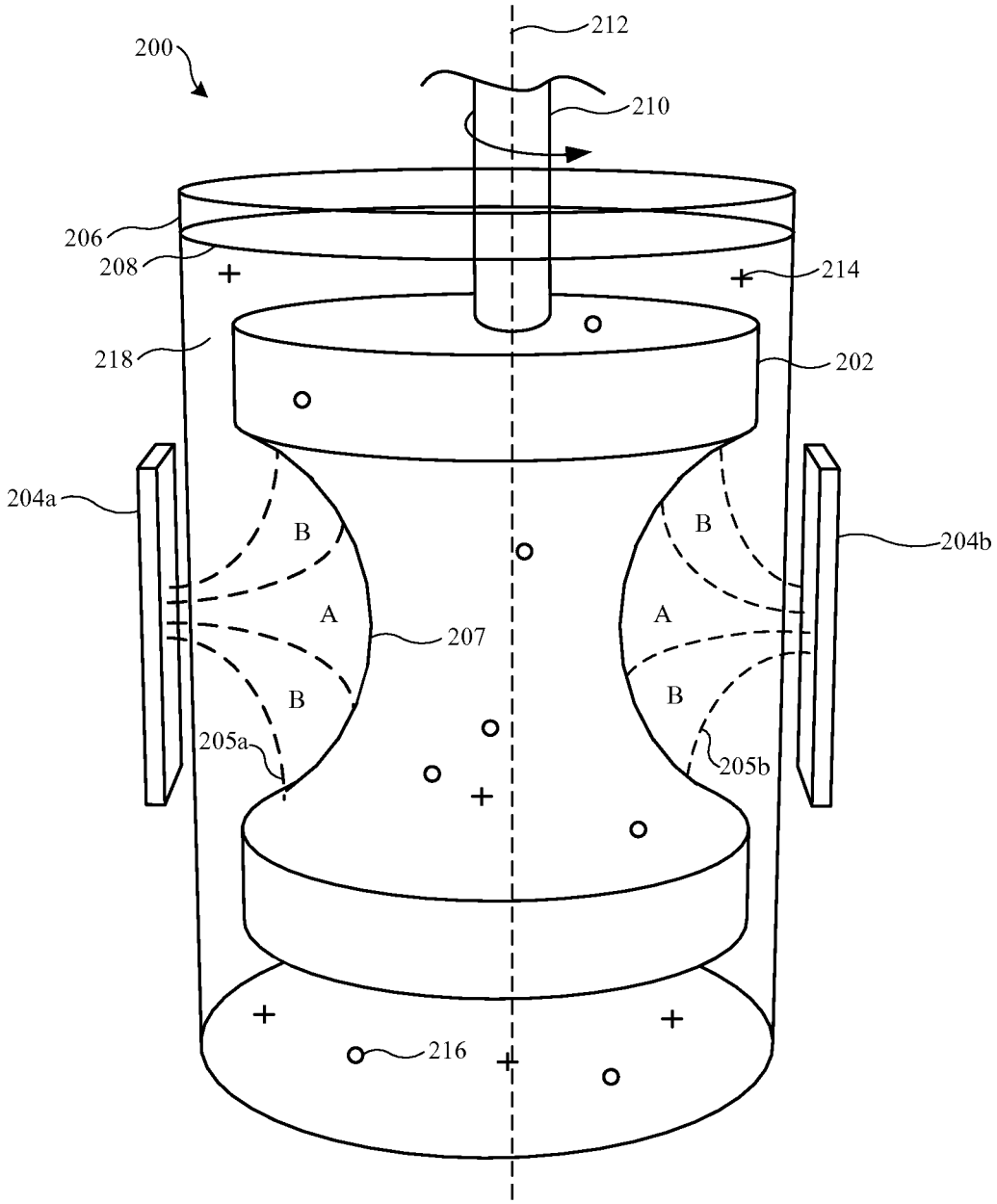
FIG. 2 shows another magnetic shaping apparatus used to shape a surface of a workpiece, in accordance with some embodiments.

FIG. 2 shows another magnetic shaping apparatus 200 used to shape workpiece 202 in accordance with some embodiments. Apparatus 200 includes magnets 204*a* and 204*b* radially arranged around container 206, which holds magnetically responsive fluid 208 and workpiece 202. Fixture 210 can support workpiece 202 within magnetically responsive fluid 208. In some embodiments, fixture 210 is configured to rotate workpiece 202 about axis 212. In some embodiments, magnets 204*a* and 204*b* are supported by a fixture or multiple fixtures (not shown) that are configured to rotate magnets 204*a* and 204*b* around container 206. Such fixture(s) are not shown for simplicity. Note that in other embodiments, magnets 204*a* and 204*b* are positioned within container 206 and magnetically responsive fluid 208.

Magnetically responsive fluid 208 includes magnetically responsive particles 214 suspended within carrier fluid 218. Magnetically responsive fluid 208 can also include abrasive particles 216 that are made of material(s) sufficiently hard to abrade workpiece 202. In some embodiments, magnetically responsive particles 214 are sufficiently hard to abrade workpiece 202 such that abrasive particles 216 are not added to magnetically responsive fluid 208. Magnets 204*a* and 204*b* are positioned such that their magnetic fields 205*a* and 205*b*, respectively, affect magnetically responsive fluid 208 near surface 207 of workpiece 202. For example, magnets 204*a* and 204*b* can be configured to provide magnetic fields 205*a* and 205*b* having stronger magnetic flux at regions A of magnetically responsive fluid 208 compared to regions B. Since magnetically responsive particles 214 are more strongly attracted to regions of greater magnetic flux, regions A can have greater densities of magnetically responsive particles 214 than regions B. The density of abrasive particles 216, which are suspended within magnetically responsive fluid 208, can also be greater at regions A compared to regions B. Put another way, the viscosity of magnetically responsive fluid 208 at regions A can be higher than at regions B. In some embodiments, the density of magnetically responsive particles 214 and abrasive particles 216 is high enough at concentrated regions A that magnetically responsive fluid 208 substantially solidifies at or near regions A.

If workpiece 202 is rotated, magnetic fields 205*a* and 205*b* that retain magnetically responsive particles 214 (and by proxy abrasive particles 216) at regions A and B can provide a resistance force that workpiece 202 moves relative to. This relative movement can create a cutting action where abrasive particles 216 cut into surface 207. Since the density of abrasive particles 216 can be higher at regions A, the rate of abrasion can be higher at portions of surface 207 proximate to regions A compared to portions of surface 207 proximate to regions B. This can result in the more material removal at surface 207 near regions A compare to regions B and the symmetrically shaped workpiece 202 shown in FIG. 2.

If magnets 204*a* and 204*b* are rotated, magnetic fields 205*a* and 205*b* can force the movement of magnetically responsive particles 214 relative to surface 207. Abrasive particles 216 can become entrained with the relative movement of magnetically responsive particles 214. This relative movement can create a cutting action where abrasive particles 216 cut into surface 207. As described above, the higher density of abrasive particles 216 at regions A can create more abrasion at regions A compared to regions B, resulting in the symmetrically shape workpiece 202 along surface 207 shown in FIG. 2.

In some embodiments, both workpiece 202 and magnets 204*a* and 204*b* are rotated. For example, workpiece 202 can be rotated in a first direction and magnets 204*a* and 204*b* can be rotated in an opposite direction. This can create more relative motion between workpiece 202 and workpiece 202, providing a faster abrasion process. It should be noted that it might be necessary to change the magnitudes of magnetic fields 205*a* and 205*b* during the shaping process in order to account for the change in shape of workpiece 202 during the shaping process. For example, it may be necessary to increase the magnitudes of magnetic fields 205*a* and 205*b*. This can be accomplished, for example, by increasing the electric current to magnets 204*a* and 204*b* if they include electromagnets. In some embodiments, the positions of magnets 204*a* and 204*b* are changed. For example, magnets 204*a* and 204*b* can be moved closer to workpiece 202 during the shaping process such that the magnetic flux of their respective magnetic fields 205*a* and 205*b* becomes greater near surface 207.

Although FIG. 2 shows two magnets 204*a* and 204*b*, in other embodiments more than two magnets are radially positioned around container 206. In some embodiments, an array of magnets, such as a Halbach array of magnets, are be used to create uniquely shaped magnetic fields within magnetically responsive fluid 208. If magnets 204*a* and 204*b* are electromagnets, the electrical current provided to magnets 204*a* and 204*b* can be changed during the shaping operation providing a pulsing action of magnetically responsive fluid 208, as described above with reference to FIG. 1.

In some embodiments, the frictional heat generated during the shaping operation is used to aid the shaping process. For example, heat generated between magnetically responsive fluid 208 and workpiece 202 can heat up workpiece 202 such that workpiece 202 is more malleable and responsive to applied pressures. Thus, in some cases the pressures applied to surface 207 of workpiece 202 by magnetically responsive particles 214 and abrasive particles 216, provided by the force of magnetic fields 205*a* and 205*b*, can be strong enough to forge workpiece 202 while in this heated and more malleable state. This can further shape workpiece 202 along surface 207. That is, the shaping operation can be a hybrid of an abrasive finishing operation and a forging operation. Heat can additionally or alternatively be supplied to workpiece 202 in other ways. For example, workpiece 202 can be heated prior to or during the shaping operation. Alternatively or additionally, magnetically responsive fluid 208 can be heated using a separate heat source (not shown), such as a hot plate. The temperature of magnetically responsive fluid 208 and/or workpiece 202 can be heated to predetermined temperature as measured using a temperature sensor, such as thermocouple (not shown).

Figure 3A:
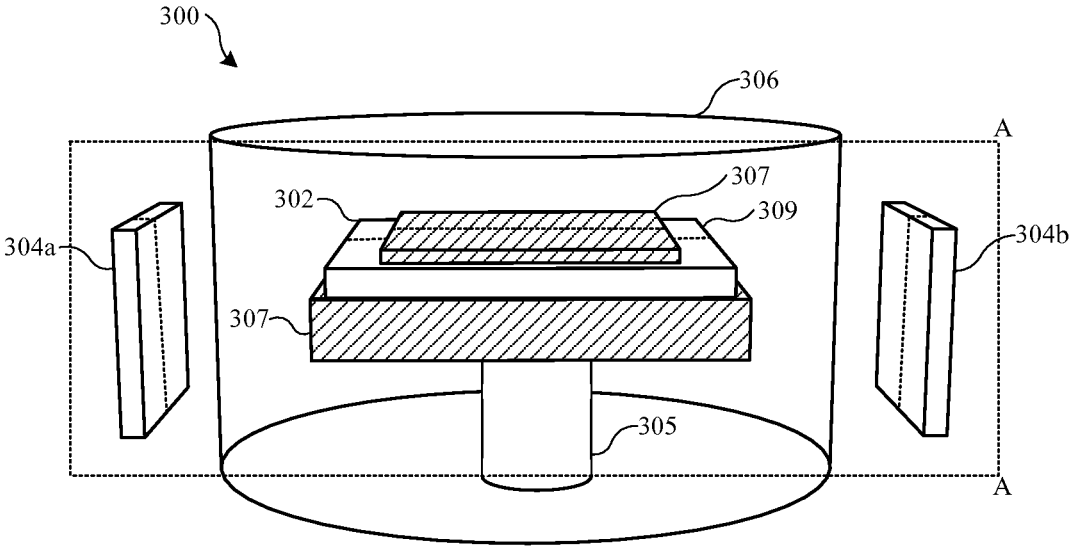
FIGS. 3A-3C show a workpiece undergoing a chamfering operation using a magnetic shaping apparatus in accordance with some embodiments.
Figure 3B:
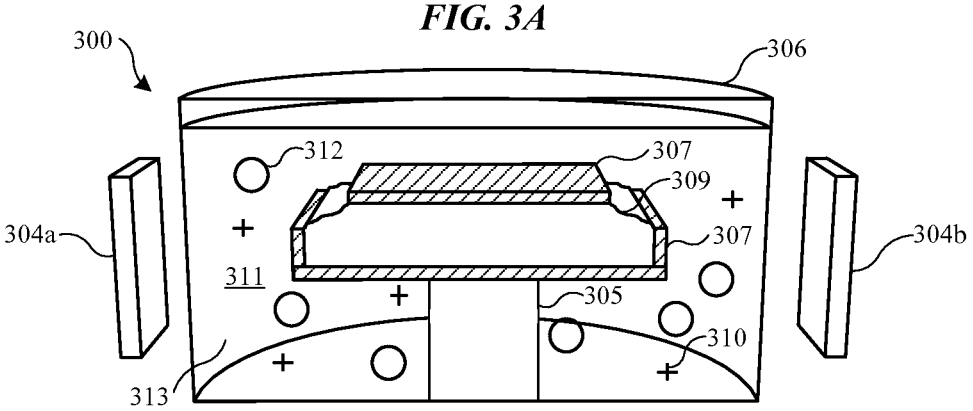
Figure 3C:
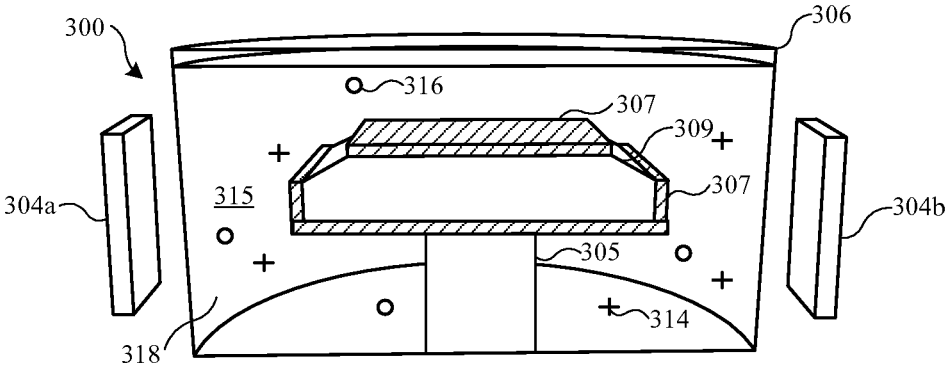

FIGS. 3A-3C show workpiece 302 undergoing a shaping operation using magnetic shaping apparatus 300, in accordance with some embodiments. FIG. 3A shows a perspective view of apparatus 300, and FIGS. 3B and 3C show cross section views A-A of apparatus 300. In FIGS. 3A-3C, magnetic shaping apparatus 300 is used to chamfer an edge of workpiece 302. FIG. 3A shows apparatus 300, which includes magnets 304*a* and 304*b* and container 306. Workpiece 302 is positioned within container 306. In some embodiments, fixture 305 positions and supports workpiece 302 within container 306. In some embodiments, fixture 305 is configured to rotate. Portions of workpiece 302 can be masked using mask 307 such that portion 309 of workpiece 302 is exposed. Mask 307 can be made of any suitable material sufficient for masking portions of workpiece 302 from exposure to a magnetically responsive fluid. For example, mask 307 can be made of a polymer material, such as a photoresist material.

At FIG. 3B, first magnetically responsive fluid 311 is added to container 306. First magnetically responsive fluid 311 includes first magnetically responsive particles 310 and first abrasive particles 312 dispersed within first carrier fluid 313. First abrasive particles 312 can be characterized have having a first average diameter configured to aggressively abrading exposed portion 309 of workpiece 302 when magnets 304*a* and 304*b* apply respective magnetic fields. Note that the magnetic fields of magnets 304*a* and 304*b* are not shown in FIGS. 3B and 3C for simplicity.

Relative movement of workpiece 302 and first abrasive particles 312 can be created using any of the techniques described above. For example, the magnitudes of the magnetic fields of magnets 304*a* and 304*b* can be changed by increasing/decreasing electric current supplied to magnets 304*a* and 304*b*. Alternatively or additionally, the polarity of magnets 304*a* and 304*b* can be repetitively switched to create a pulsing action of first magnetically responsive particles 310 and, in turn, first abrasive particles 312 with respect to workpiece 302. Additionally or alternatively, fixture 305 and/or magnets 304*a* and 304*b* can be rotated. These motions can give first abrasive particles 312 a cutting action that cuts and removes material from exposed portion 309 of workpiece 302. As shown, exposed portion 309 has a rough surface since first abrasive particles 312 are configured to provide an aggressive rough cut. Other parameters that can affect the roughness of exposed portion 309 can include the magnitudes of the magnetic fields of magnets 304*a* and 304*b*, the amount of abrasive particles 312 within magnetically responsive fluid 311, and the rotational speeds of fixture 305 and/or magnets 304*a* and 304*b*.

At FIG. 3C, first magnetically responsive fluid 311 is replaced with second magnetically responsive fluid 315 within container 306. Second magnetically responsive fluid 315 includes second magnetically responsive particles 314 and second abrasive particles 316 dispersed within second carrier fluid 318. Second abrasive particles 316 can be characterized have having a second average diameter configured to gently abrade exposed portion 309 of workpiece 302 when magnets 304*a* and 304*b* apply respective magnetic fields. In some embodiments, the second average diameter of second abrasive particles 316 is smaller than first average diameter of first abrasive particles 312. In some embodiments, the shapes of first abrasive particles 312 and second abrasive particles 316 are different. For example, first abrasive particles 312 can have more irregular shapes and have sharper edges that are capable of more efficient cutting compared to second abrasive particles 316. First magnetically responsive particles 310 can be different or the same type or material as second magnetically responsive particles 314. First carrier fluid 313 can be different or the same type as second carrier fluid 318.

The relatively gentle abrasive action of second abrasive particles 316 can polish exposed portion 309. The magnitudes of the magnetic fields of magnets 304*a* and 304*b*, the amount of abrasive particles 316 within magnetically responsive fluid 315, and the rotational speeds of fixture 305 and/or magnets 304*a* and 304*b* can also be adjusted to provide a desired amount of polishing and removal. After the polishing process is complete, mask 307 can be removed from workpiece 302, revealing portions of workpiece 302 substantially unaffected by the shaping process and resulting in chamfered workpiece 302.

Figure 4A:
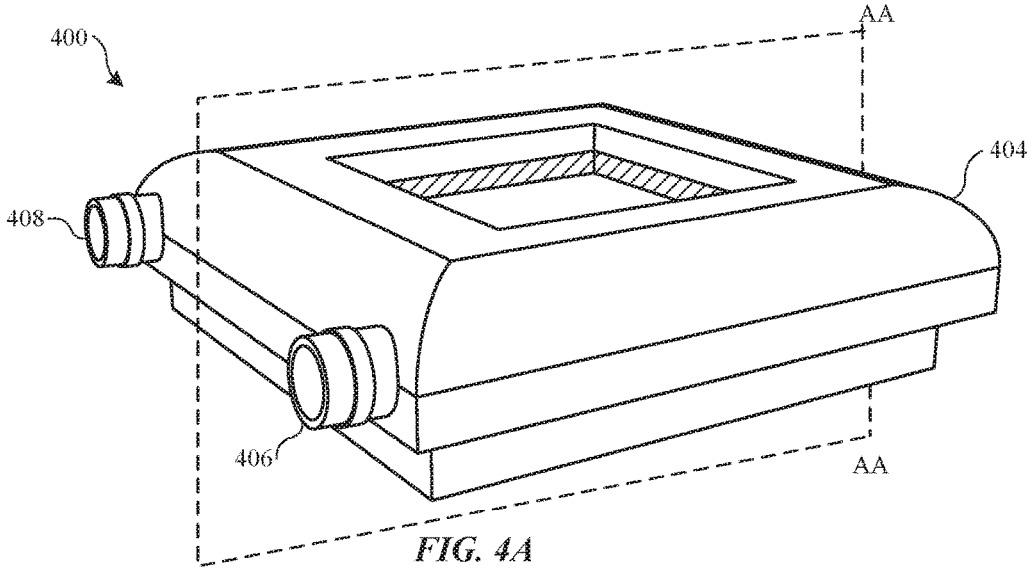
FIGS. 4A-4C show a workpiece undergoing a chamfering operation using a magnetic shaping apparatus in accordance with other embodiments.
Figure 4B:
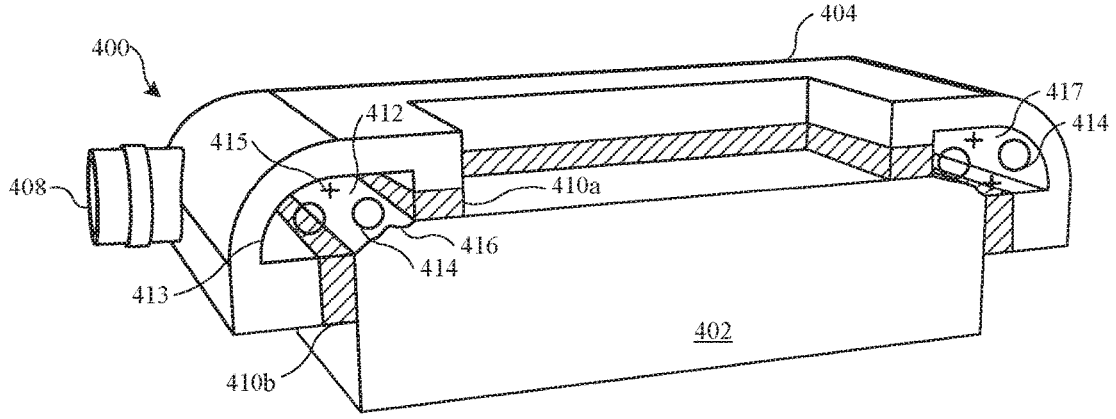
Figure 4C:
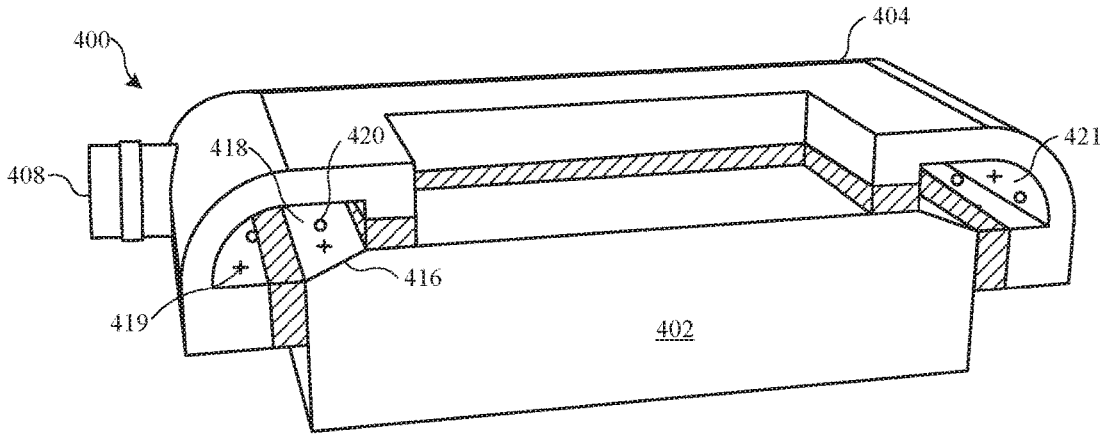

FIGS. 4A-4C show an alternative chamfering operation, in accordance with some embodiments. FIG. 4A shows a perspective view of apparatus 400, and FIGS. 4B and 4C show cross section views A-A of apparatus 400. FIG. 4A shows apparatus 400, which includes fixture 404 that is configured to create a chamfer along an edge of workpiece 402. Fixture 404 includes inlet 406 and outlet 408 configured to provide entry and exit, respectively, of a magnetically responsive fluid within a channel of fixture 404.

FIG. 4B shows a cross section view of apparatus 400 after channel 413 is filled with first magnetically responsive fluid 412 via inlet 406. First magnetically responsive fluid 412 includes first magnetically responsive particles 415 and first abrasive particles 414 suspended within first carrier fluid 417. Magnets 410*a* and 410*b* are positioned around channel 413 and configured to direct first magnetically responsive fluid 412. Magnetic fields of magnets 410*a* and 410*b* control movement of first magnetically responsive particles 415 with respect to exposed portion 416 of workpiece 402.

Relative movement of first abrasive particles 414 and workpiece 402 can be created using any of the techniques described above. For example, magnet 410*a* can have a polarity that is opposite of the polarity of magnet 410*b*. This can create a strong magnetic flux near exposed portion 416, causing first magnetically responsive particles 415 and first abrasive particles 414 to be concentrated near exposed portion 416 of workpiece 402. In some embodiments, the polarities of magnets 410*a* and 410*b* are repeatedly switched during the operation, causing the magnetic fields of magnets 410*a* and 410*b* to change. This can provide motion that allows first abrasive particles 414 to cut and abrade exposed portion 416. In some embodiments, further motion is provided by the physical flow of first magnetically responsive fluid 412 across exposed portion 416 within channel 413. For example, a pump (not shown) can pump magnetically responsive fluid 412 through channel 413. First magnetically responsive fluid 412 can be configured to provide a rough cut to exposed portion 416. First abrasive particles 414 are characterized as having a first average diameter that can be chosen to provide aggressive abrasion of workpiece 402.

At FIG. 4C, first magnetically responsive fluid 412 is replaced with second magnetically responsive fluid 418, which includes second magnetically responsive particles 419 and second abrasive particles 420 dispersed within second carrier fluid 421. Second abrasive particles 420 can be characterized have having a second average diameter configured to gently abrade exposed portion 416 of workpiece 302 when magnets 410*a* and 410*b* apply respective magnetic fields. In some embodiments, the second average diameter of second abrasive particles 420 is smaller than the first average diameter of first abrasive particles 414, and the shapes of first abrasive particles 414 and second abrasive particles 420 are different. First magnetically responsive particles 415 can include different or the same material as second magnetically responsive particles 419. First carrier fluid 417 can be different or the same type as second carrier fluid 421. After exposed portion 416 of workpiece 302 is abraded to a desired finish, workpiece 402 is removed from fixture 404 with a chamfered and polished edge.

Figure 5:
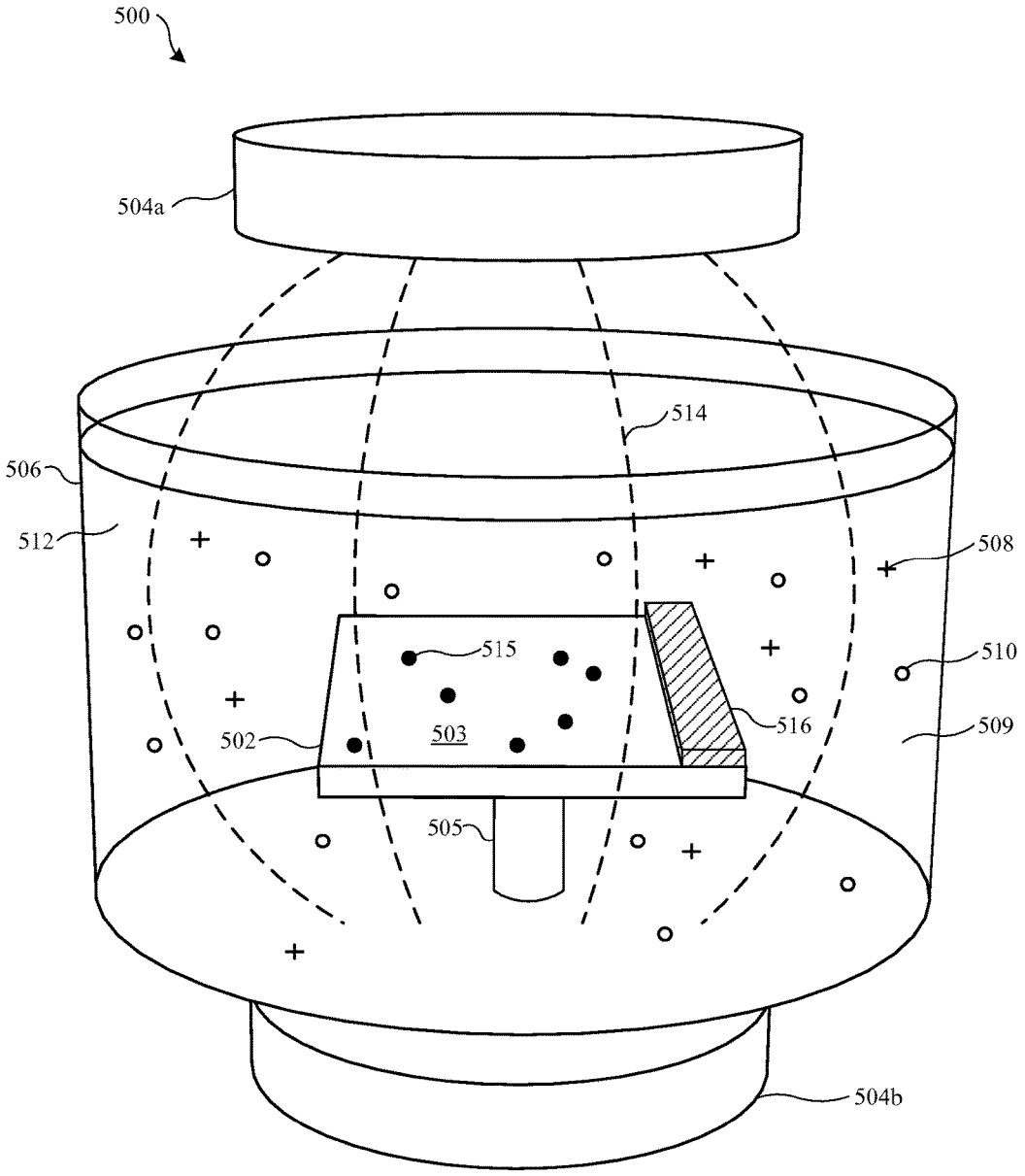
FIG. 5 shows a magnetic finishing apparatus configured to provide a texture surface on a workpiece.

FIG. 5 shows a perspective view of magnetic finishing apparatus 500 configured to provide a textured to surface 503 of workpiece 502. Apparatus 500 includes container 506 and magnets 504*a* and 504*b*. Workpiece 502 can be supported by fixture 505 within container 506. Container is configured to hold magnetically responsive fluid 512, which includes magnetically responsive particles 508 and abrasive particles 510 within carrier liquid 509. Magnets 504*a* and 504*b* can each include one or more electromagnets and permanent magnets. Magnetic fields from magnets 504*a* and 504*b* combine to create a combined magnetic field 514 that preferentially directs magnetically responsive particles 508 toward surface 503. Abrasive particles 510 become entrained with the movement of magnetically responsive particles 508 toward surface 503 and impinge upon surface 503, creating corresponding indentations 515. The force at which abrasive particles 510 impact surface 503 will, in part, depend on the force of combined magnetic field 514, which can be adjusted by adjusting the strength of each of magnets 504*a* and 504*b*. In some cases, magnets 504*a* and 504*b* have opposing polarities, which are repeatedly switched. As described above, other process parameters such as the size and shape of abrasive particles 510, can be chosen to create a predefined texture to surface 503.

In some embodiments, portions of workpiece 502 are masked using mask 516 such that a portion of workpiece 502 is exposed. Mask 516 can be made of any suitable material sufficient for masking portions of workpiece 502 from exposure to magnetically responsive fluid 512. For example, mask 516 can be made of a polymer material, such as a photoresist material. After the texturing operation is complete, mask 516 can be removed such that the portion of workpiece 502 covered by mask 516 having a pre-texturing surface finish is exposed. In some embodiments, the portion of workpiece 502 covered by mask 516 has a shiny reflective surface. Thus, surface 503 of workpiece 502 can have a textured portion and an untextured portion.

Figure 6:
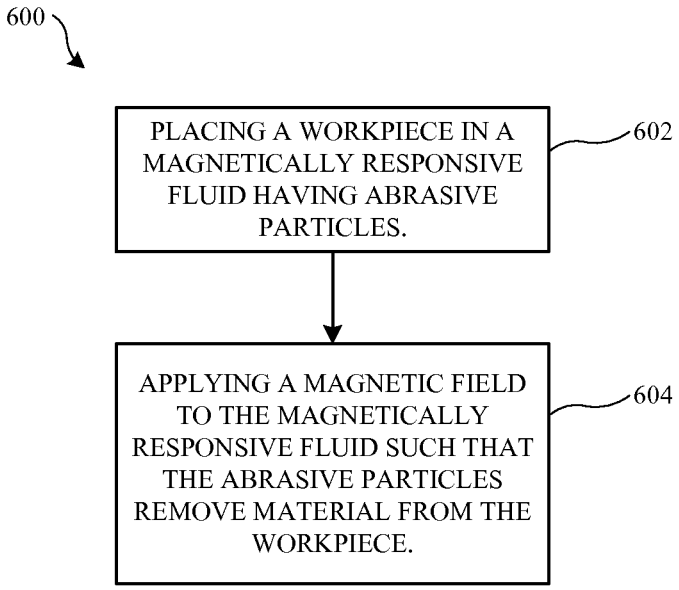
FIG. 6 shows a flowchart indicating a magnetic shaping or finishing process in accordance with some embodiments.

FIG. 6 shows flowchart 600 indicating a process for shaping and/or finishing a workpiece using a magnetic shaping apparatus according to some embodiments. At 602, a workpiece is placed within a magnetically responsive fluid. The magnetically responsive fluid includes magnetically responsive particles within a carrier fluid. In some embodiments, the magnetically responsive fluid is a ferrofluid. In some embodiments, the magnetically responsive particles can act as abrasive particles during a shaping or finishing operation. In some embodiments, separate abrasive particles are added to the magnetically responsive fluid. In some embodiments, the abrasive particles include one or more of zirconia, titania, and alumina.

At 604, a magnetic field is applied to the magnetically responsive fluid such that magnetically responsive particles and/or abrasive particles remove material from the workpiece. The apparatus can be configured to provide a rough cut, similar to a machining process or a fine cut, similar to a polishing or buffing process. In some embodiments, the same apparatus can be used to rough cut (e.g., similar to machining) the workpiece and fine cut (e.g., polish) the workpiece. For example, a first magnetic fluid having abrasive particles with relatively sharp edges and/or large average diameter can be used with a strong magnetic force to provide the rough cutting. A second magnetic fluid having abrasive particles with rounded edges (e.g., spherical shapes) and/or small average diameter can be used with a weaker magnetic force to provide the fine cutting.

The magnetic fields can be created by one or more magnets placed in proximity to the magnetically responsive fluid and positioned to direct movement of the magnetically responsive particles along predefined paths across the surface of the workpiece. Abrasive particles can become entrained with the movement of the magnetically responsive particles and abrade surfaces of the workpiece in accordance with the predefined paths until the workpiece takes on a desired shape. One advantage of the magnetic techniques provided herein over conventional machining operations is that tool wear can be an issue with conventional machining techniques. In magnetic-based shaping operations described herein, the magnetically responsive fluid can take place of tools, thereby eliminating tool wear issues. The magnetically responsive fluid can be replaced with new magnetically responsive fluid having new abrasive particles.

Figure 7:
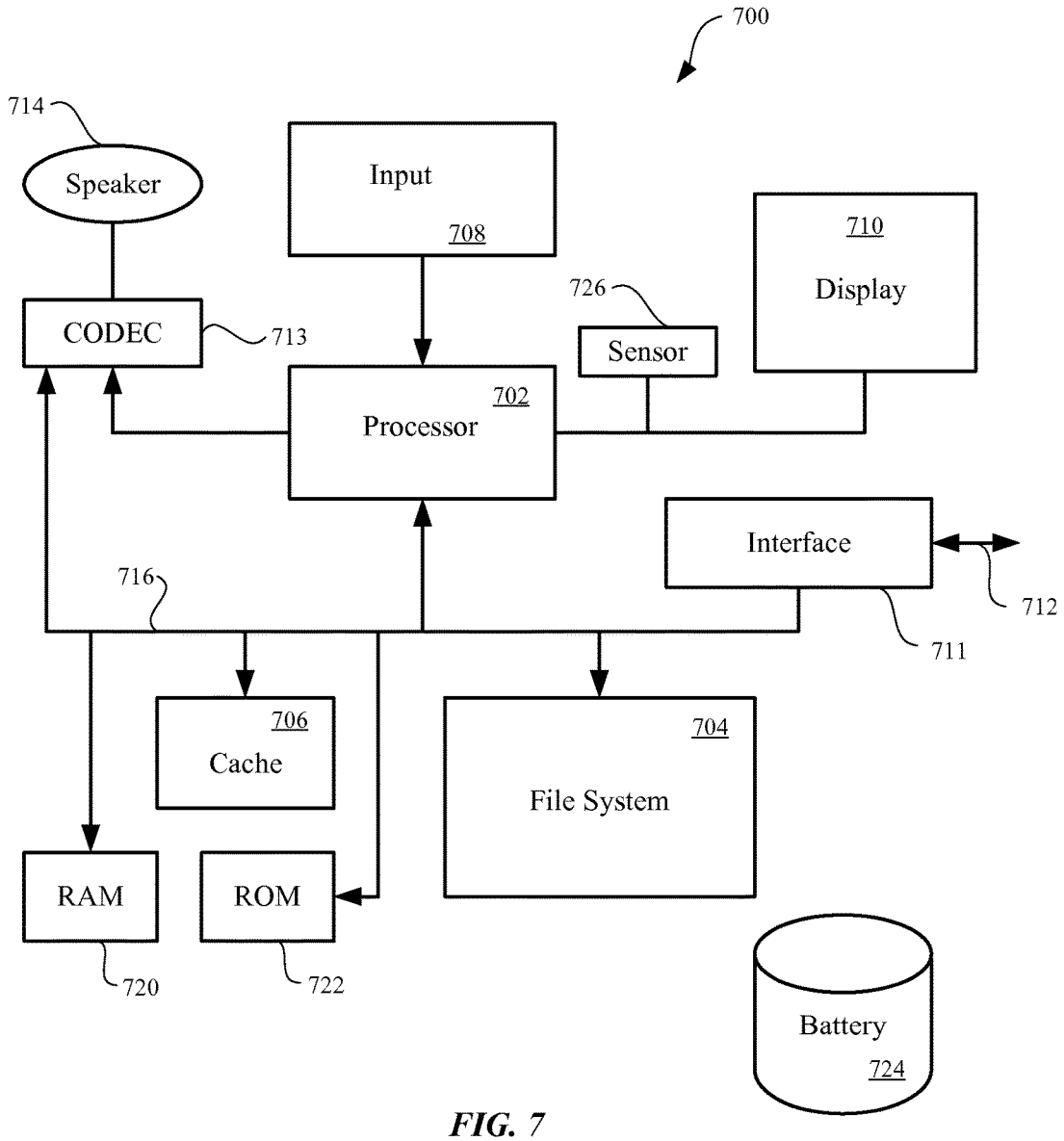
FIG. 7 shows a block diagram of an electronic system suitable for controlling the magnetic shaping and finishing processes according to some embodiments.

FIG. 7 is a block diagram of electronic system 700 suitable for controlling some of the magnetic and/or finishing processes described above. Electronic system 700 can represent a computing system in conjunction with a magnetic shaping and/or finishing apparatus such as a magnetic shaping and/or finishing apparatus described above. Electronic system 700 includes a processor 702 that pertains to a microprocessor or controller for controlling the overall operation of electronic system 700. Electronic system 700 contains instruction data pertaining to manufacturing instructions in a file system 704 and a cache 706. The file system 704 is, typically, a storage disk or multiple disks. The file system 704 typically provides high capacity storage capability for the electronic system 700. However, since the access time to the file system 704 can be relatively slow, electronic system 700 can also include a cache 706. Cache 706 can be, for example, Random-Access Memory (RAM) provided by semiconductor memory. The relative access time to the cache 706 can be substantially shorter than for the file system 704. However, cache 706 may not have the large storage capacity of the file system 704. Further, file system 704, when active, can consume more power than cache 706. The power consumption is often a concern when the electronic system 700 is a portable device that is powered by a battery 724. The electronic system 700 can also include a RAM 720 and a Read-Only Memory (ROM) 722. ROM 722 can store programs, utilities or processes to be executed in a non-volatile manner. RAM 720 can provide volatile data storage, such as for cache 706.

Electronic system 700 can also include a user input device 708 that allows a user of the electronic system 700 to interact with the electronic system 700. For example, a user input device 708 can take a variety of forms, such as a button, keypad, dial, touch screen, audio input interface, visual/image capture input interface, input in the form of sensor data, etc. Still further, the electronic system 700 can include a display 710 (screen display) that can be controlled by the processor 702 to display information to the user. As described above, in some embodiments, display 710 provides images collected from an imaging tool. Data bus 716 can facilitate data transfer between at least the file system 704, the cache 706, the processor 702, and a coder/decoder (CODEC) 713. CODEC 713 can be used to decode and play multiple media items from file system 704 that can correspond to certain activities taking place during a particular manufacturing process. Processor 702, upon a certain manufacturing event occurring, supplies the media data (e.g., audio file) for the particular media item to a CODEC 713. CODEC 713 can then produce analog output signals for a speaker 714. Speaker 714 can be a speaker internal to electronic system 700 or external to electronic system 700. For example, headphones or earphones that connect to the electronic system 700 would be considered an external speaker.

Electronic system 700 can also include a network/bus interface 711 that couples to a data link 712. Data link 712 can allow electronic system 700 to couple to a host computer or to accessory devices. Data link 712 can be provided over a wired connection or a wireless connection. In the case of a wireless connection, network/bus interface 711 can include a wireless transceiver. The media items (media assets) can pertain to one or more different types of media content. In one embodiment, the media items are audio tracks (e.g., songs, audio books, and podcasts). In another embodiment, the media items are images (e.g., photos). However, in other embodiments, the media items can be any combination of audio, graphical or visual content. Sensor 726 can take the form of circuitry for detecting any number of stimuli. For example, sensor 726 can include any number of sensors for monitoring a manufacturing operation such as for example a Hall Effect sensor responsive to external magnetic field, an audio sensor, a light sensor such as a photometer, and so on.

The various aspects, embodiments, implementations or features of the described embodiments can be used separately or in any combination. Various aspects of the described embodiments can be implemented by software, hardware or a combination of hardware and software. The described embodiments can also be embodied as computer readable code on a non-transitory computer readable medium for controlling manufacturing operations or as computer readable code on a non-transitory computer readable medium for controlling a manufacturing line. The non-transitory computer readable medium is any data storage device that can store data, which can thereafter be read by a computer system. Examples of the non-transitory computer readable medium include read-only memory, random-access memory, CD-ROMs, DVDs, magnetic tape, optical data storage devices, and carrier waves. The non-transitory computer readable medium can also be distributed over network-coupled computer systems so that the computer readable code is stored and executed in a distributed fashion.

It should be noted that the embodiments described above with reference to FIGS. 1-7 are provided for illustrative purposes and not meant to limit the scope of inventive aspects of the instant disclosure. That is, other suitable embodiments having similar features can fall within the scope of the disclosure described herein. In addition, any suitable combinations of features of FIGS. 1-7 can be used within the scope of the present disclosure.

The foregoing description, for purposes of explanation, used specific nomenclature to provide a thorough understanding of the described embodiments. However, it will be apparent to one skilled in the art that the specific details are not required in order to practice the described embodiments. Thus, the foregoing descriptions of the specific embodiments described herein are presented for purposes of illustration and description. They are not meant to be exhaustive or to limit the embodiments to the precise forms disclosed.

It will be apparent to one of ordinary skill in the art that many modifications and variations are possible in view of the above teachings.

What is claimed is:

1. A method of shaping a workpiece, the method comprising:

positioning a fixture such that walls of the fixture cooperate with a portion of a workpiece surface to define a channel for holding a magnetically responsive fluid having magnetically attractable particles and abrasive particles, wherein only the portion of the workpiece surface is immersed within the magnetically responsive fluid; and causing a magnetic field of a magnet arranged with respect to the workpiece to move the magnetically responsive fluid in a path across the portion of the workpiece surface, wherein movement of the magnetically responsive fluid provides a cutting action sufficient for the abrasive particles to remove material from the portion of the workpiece surface resulting in the workpiece taking on a predefined shape.

2. The method of claim 1, further comprising filling the channel with the magnetically responsive fluid via an inlet of the fixture.

3. The method of claim 1, further comprising emptying the channel of the magnetically responsive fluid via an outlet of the fixture.

4. The method of claim 1, wherein the magnetically attractable particles and the abrasive particles both provide the cutting action that removes the material from the workpiece.

5. The method of claim 1, wherein the magnetically responsive fluid includes carrier fluid that includes organic fluid, aqueous fluid, or a combination thereof.

6. The method of claim 1, wherein the workpiece is fixed with respect to the fixture during a shaping operation.

7. The method of claim 1, wherein more than one magnet is used to move the magnetically responsive fluid.

8. The method of claim 1, wherein the abrasive particles are characterized as having a first diameter, the method further comprising:

moving a second magnetically responsive fluid comprising a second type of abrasive particles across the portion of the workpiece surface, the second type of abrasive particles characterized as having a second diameter smaller than the first diameter.

9. A magnetic shaping apparatus, comprising:

a fixture including walls that cooperate with a portion of a workpiece surface to define a channel configured to hold a magnetically responsive fluid having magnetically attractable particles and abrasive particles suspended in a carrier fluid, wherein the fixture is configured to immerse only the portion of the workpiece surface within the magnetically responsive fluid; and a magnet arranged with respect to the workpiece such that the magnet directs movement of the magnetically responsive fluid in a path across the immersed portion the workpiece surface, wherein movement of the magnetically responsive fluid provides a cutting action sufficient for the abrasive particles to remove material from the immersed portion of the workpiece surface resulting in the immersed portion of the workpiece surface taking on a predefined shape.

10. The magnetic shaping apparatus of claim 9, wherein the magnet includes a permanent magnet, an electromagnet and/or a superconducting magnet.

11. The magnetic shaping apparatus of claim 9, wherein the magnet is an electromagnet that is supplied electric current by a power supply.

12. The magnetic shaping apparatus of claim 11, wherein a magnetic flux of the electromagnet is varied during a shaping operation.

13. The magnetic shaping apparatus of claim 9, wherein the magnetic shaping apparatus includes two or more magnets, wherein polarities of the two or more magnets are switched during a shaping operation.

14. The magnetic shaping apparatus of claim 9, wherein the fixture is fixed with respect the workpiece during a shaping operation the magnetically responsive fluid.

15. The magnetic shaping apparatus of claim 9, wherein the fixture includes an inlet and an outlet for the magnetically responsive fluid.

16. A magnetic shaping apparatus for shaping a workpiece, comprising:

a fixture including walls that cooperate with a portion of a workpiece surface to define a channel for holding a magnetically responsive fluid having magnetically attractable particles and abrasive particles, wherein the fixture is configured to immerse only the portion of the workpiece surface within the magnetically responsive fluid;

an electromagnet arranged with respect to the workpiece such that a magnetic field of the electromagnet directs movement of the magnetically responsive fluid in a path across the portion of the workpiece surface, wherein movement of the magnetically responsive fluid provides a cutting action sufficient for the abrasive particles to remove material from the workpiece; and a power supply configured to supply varying amounts of electric current to the electromagnet, wherein an amount of electric current supplied to the electromagnet is associated with a strength of the magnetic field.

17. The magnetic shaping apparatus of claim 16, wherein the magnetically attractable particles are comprised of a ferromagnetic material.

18. The magnetic shaping apparatus of claim 16, wherein the abrasive particles are comprised of a non-metallic material.

19. The magnetic shaping apparatus of claim 18, wherein the abrasive particles are comprised of one or more of zirconia, titania, and alumina.

20. The magnetic shaping apparatus of claim 16, wherein the magnetic shaping apparatus additionally includes a permanent magnet and/or a superconducting magnet.

* * * * *